US005669375A

United States Patent [19]

Dahrendorf et al.

[11] Patent Number: 5,669,375

[45] Date of Patent: Sep. 23, 1997

[54] BREATHING MASK

[75] Inventors: Klaus-Dieter Dahrendorf, Berlin; Joachim Schlobohm, Oldesloe; Günter Von Kopp, Berlin; Wolfgang Drews, Zarpen; Joachim W. Siegel, Rondeshagen, all of Germany

[73] Assignees: Drägerwerk Aktiengesellschaft, Lübeck; Auergesellschaft GmbH, Berlin, both of Germany

[21] Appl. No.: 716,476

[22] Filed: Sep. 19, 1996

[30] Foreign Application Priority Data

Sep. 21, 1995 [DE] Germany ..... 195 34 985.7

[51] Int. Cl.[6] ..... A62B 18/02; A62B 18/08

[52] U.S. Cl. ..... 128/206.17; 128/206.12; 128/205.29; 128/206.28

[58] Field of Search ..... 128/205.27, 205.29, 128/206.19, 205.28, 206.12, 206.14, 206.16, 206.17, 206.21, 206.28, 207.11

[56] References Cited

U.S. PATENT DOCUMENTS

| | | | |
|---|---|---|---|
| 2,575,483 | 11/1951 | Bethig | 128/206.12 X |
| 5,148,803 | 9/1992 | Schlobohm | 128/205.27 |
| 5,154,168 | 10/1992 | Schlobohm | 128/205.27 |
| 5,427,092 | 6/1995 | Shiao | 128/206.12 |

FOREIGN PATENT DOCUMENTS

| | | | |
|---|---|---|---|
| 1 012 689 | 12/1927 | Germany . | |
| 17 08 046 | 8/1975 | Germany . | |
| 89613 | 6/1937 | Sweden | 128/206.12 |
| 22944 | 6/1915 | United Kingdom | 128/206.12 |

*Primary Examiner*—Vincent Millin
*Assistant Examiner*—Eric P. Raciti
*Attorney, Agent, or Firm*—McGlew and Tuttle

[57] ABSTRACT

A breathing mask with a mask body designed as a full mask with a field of vision and with a filter with a filter connection 13, wherein the filter can be arranged in the middle 3 of the mask body or to the side of it in the cheek area, is to be improved such that the use properties with the filter attached are improved in terms of the position of the center of gravity, a larger field of vision is present, and there is good adaptability to optical devices. To accomplish this task, the filter is designed as a cassette filter extending in the shape of a U from the middle of the mask body to the cheek area, and the field of vision includes a transparent, elastic elastomer section, into which individual, segment-like eye-protective lenses made of a solid material are inserted.

11 Claims, 2 Drawing Sheets

BREATHING MASK

FIELD OF THE INVENTION

The present invention pertains to a breathing mask with a mask body designed as a full mask and with a field of vision region and a filter region. The filter is provided with a filter connection and the filter is arranged in a center of the mask body or on a side of the mask body.

BACKGROUND OF THE INVENTION

A breathing mask with a mask body designed as a full mask has become known from DE Patent No. 17 08 046. The prior-art breathing mask comprises a mask body with connection possibilities for filters and breathing valves. The mask body is designed such that two filters can be accommodated on the side in the cheek area of the mask body, or a single filter is inserted into the mask body in the middle of the mask body in the area of the mouth. Two flat glasses, which are directly fastened in the material of the mask body, are provided in the range of vision of the mask body.

The disadvantage of the prior-art breathing mask is the fact that the center of gravity of the breathing mask is shifted forward due to the filters being arranged on the side or also by the filter being located in the middle of the mask body, which considerably impairs the comfort of use. In addition, the projecting filters interfere with the operation of devices. The two glasses in the mask body limit the field of vision to an area located directly in front of the eyes of the user of the mask and do not allow vision in the lateral range of the mask body. In addition, only insufficient adaptation of the glasses to optical devices is possible in the prior-an breathing mask, because the glasses are fixed in the material of the mask body. Distortions or even reflections, which make the use of optical devices difficult, may be generated by an angular offset between the disks and the lenses of the optical device.

A face mask with four glasses inserted into the mask body, two of which are arranged in the area of the middle of the mask body and the other two glasses are arranged in the side areas of the mask body, has been known from DE-GM 10 12 689. Even though the field of vision is enlarged due to the segment-like division of the glasses compared with an arrangement with only two glasses, the field of perception is limited in a punctiform pattern to the individual fields of vision of the glasses, which impairs the use of the mask in the dose range.

SUMMARY AND OBJECTS OF THE INVENTION

The primary object of the present invention is to improve a breathing mask of the above-described class such that the use properties with the filter attached are improved in terms of the position of the center of gravity, a larger field of vision is present, and there is good adaptability to optical devices.

According to the invention, a breathing mask is provided with a masked body designed as a full mask including a field of vision region which comprises a transparent flexible elastomer section into which individual segmented eye protective lenses made of solid material are inserted. A filter with a filter connection is provided wherein the filter can be arranged in a middle of the mask body or on a side of the mask body and the filter is designed as a filter element extending in a U-shape manner from the middle of the mask body to the cheek area of the mask body.

The advantage of the present invention is essentially that due to the filter being designed as a U-shaped filter element surrounding the mask body from the middle of the mask body into the cheek area, the center of gravity is shifted toward the user of the mask, and, in addition, the dead space in the cheek area of the breathing mask is utilized especially well, which markedly increases the suitability for use of the breathing mask. The field of vision is markedly increased due to the arrangement of a rectangular, transparent elastomer section in the field of vision of the mask body, into which individual eye-protective lenses are inserted, because visual perceptibility of the environment is now also ensured outside the eye-protective lenses. The eye-protective lenses are made of a solid, optical material possessing good transmission properties. Especially good adaptability to optical devices is achieved due to the eye-protective lenses being fastened within the flexible elastomer section, because the eye-protective lenses can be tilted or even displaced.

The mask body is advantageously designed as a filter mount shaped corresponding to the inner surface of the filter element in the area of the filter element, and with the filter element pushed over the mask body, the inner surface of the filter is flush with the filter mount. The filter connection of the filter element is preferably arranged in the middle of the mask body. The filter connection may be designed as a plug-in-type, screw or bayonet connection, and the plug-in-type connection represents the preferred embodiment.

The eye-protective lenses are preferably designed as, e.g., triangular eye-protective lenses tapering toward the middle of the mask body, which are located in the main field of vision of the mask user, and as, e.g., semicircular second eye-protective lenses extending in a round shape in the rearward direction, which are arranged in the lateral area of the mask body. Flat or spherically curved glasses may be used as eye-protective lenses. Due to the eye-protective lenses being fastened within the flexible elastomer section, they are displaceable and tiltable in relation to one another and can be especially well adapted to optical devices as a result. It is also possible due to the flexibility of the elastomer section to bring the eye-protective lenses closer to the face, i.e., to the eyes of the mask user, e.g., at the time of the attachment of an optical device. The eye-protective lenses may be molded or bonded into the elastomer section. The elastomer section is made of a transparent, thermoplastic elastomer (TPE).

A bracket for holding a speaking membrane is preferably arranged in the middle of the mask body. The speaking membrane is located approximately in the area of the mouth of the mask user. Especially good communication is thus possible.

The expiration valve is preferably arranged at the deepest point of the mask body, i.e., under the filter element in the chin area. Water of condensation that may be present within the mask body is thus able to flow off directly into the environment.

A total of six fastening points for disposing a head harness are arranged on the mask body, and two of the fastening points are located at the level of the filter element on the mask body in order to support the breathing mask in the area of the center of gravity. Especially pleasant use properties of the breathing mask are thus obtained. The fastening points located at the level of the filter element may also be arranged directly at the filter element, or there are fastening points at both the mask body and the filter element. Supporting of the breathing mask in the area of the center of gravity is additionally improved due to the involvement of the filter element in the fastening of the head harness.

The filter element is advantageously designed such that the gas inlet openings are located at the ends of the side pans, i.e., at the ends of the legs of the U-shaped filter element. The gas will thus flow symmetrically from the two opposite gas inlet openings toward the centrally arranged filter connection. The filter element contains individual sorption layers made of, e.g., activated carbon, to adsorb harmful gases. An advantageous order of the air-cleaning layers within the filter element is a nonwoven body acting as a particle separator and one or more activated carbon cartridges for adsorbing harmful gases.

The filter element is advantageously designed as a cassette filter with a filter housing that can be opened and into which individual air-cleaning layers can be placed or from which such individual air-cleaning layers can be removed after use. The preparation of the cassette filter for use is thus substantially simplified, because the filter housing can be used several times, and only the air-cleaning layers must be replaced. The sorption layers used up can thus be directly subjected to reprocessing.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
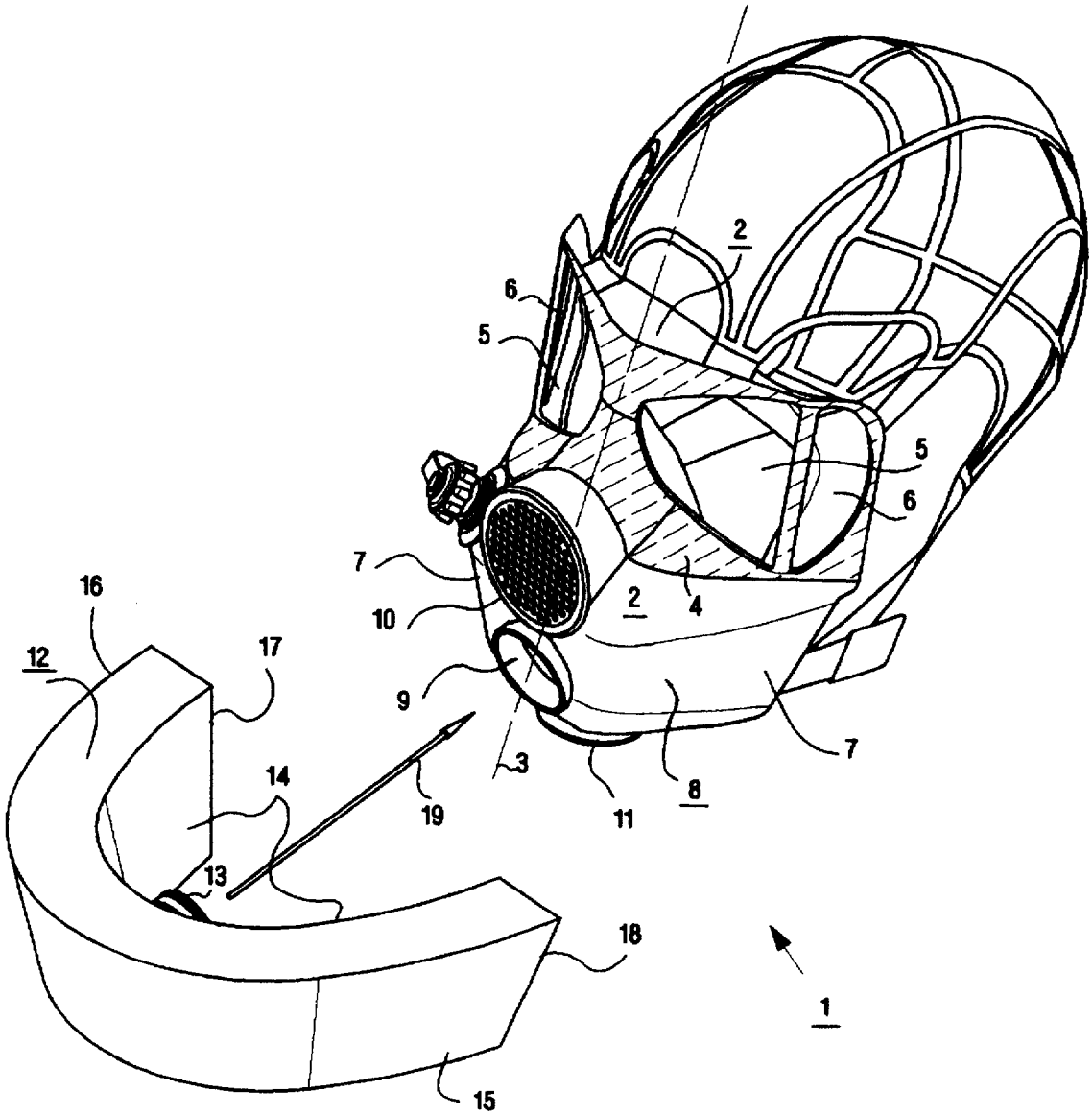
FIG. 1 is a perspective view of a breathing mask with the cassette filter removed.

Referring to the drawings in particular, FIG. 1 shows a breathing mask 1 with a mask body 2 designed as a full mask, which is made of a thermoplastic elastomer (TPE) and is designed at the same time as a sealing rim against the face of a mask user, not shown in FIG. 1. The mask body 2 is designed symmetrically to the middle 3 of the mask body, as an axis of symmetry of the breathing mask 1. A rectangular opening, which is closed with a rectangular, flexible and transparent elastomer section 4 of a corresponding design, is provided in the field of vision of the mask body 2. The elastomer section 4 also consists of a TPE. Two triangular, first eye-protective lenses 5 tapering toward the middle 3 of the mask body, and semicircular, second eye-protective lenses 6, which are located behind the first eye-protective lenses 5 in the field of vision of the mask body 2 when viewed from the middle 3 of the mask body, are inserted into the elastomer section 4, which is highlighted in FIG. 1 by shading. The first eye-protective lenses 5 form an angle of about 170° with one another, and the second eye-protective lenses 6 form an angle of about 120° with the respective adjacent first eye-protective lenses 5. It is thus achieved that the eye-protective lenses 5, 6 have only a small angular offset in relation to the visual axis of the mask user in both the front area and the side area of the mask body 2.

The lower part of the mask body 2 is designed as a U-shaped filter mount 8 with a breathing connection 9 from the middle 3 of the mask body to the cheek area 7. A bracket 10 for a speaking membrane, not shown in FIG. 1, is located above the breathing connection 9, and an expiration valve 11 is arranged under the breathing connection 9.

A cassette filter 12, bent in the shape of a U, acting as a filter element with a filter connection 13, has an inner surface 14, which is shaped corresponding to the filter mount 8. The cassette filter 12 can thus be pushed over the filter mount 8 in an accurately fitting manner. When the cassette filter 12 is pushed over the filter mount 8 along arrow 19, the filter connection 13 engages the breathing connection 9.

Figure 2:
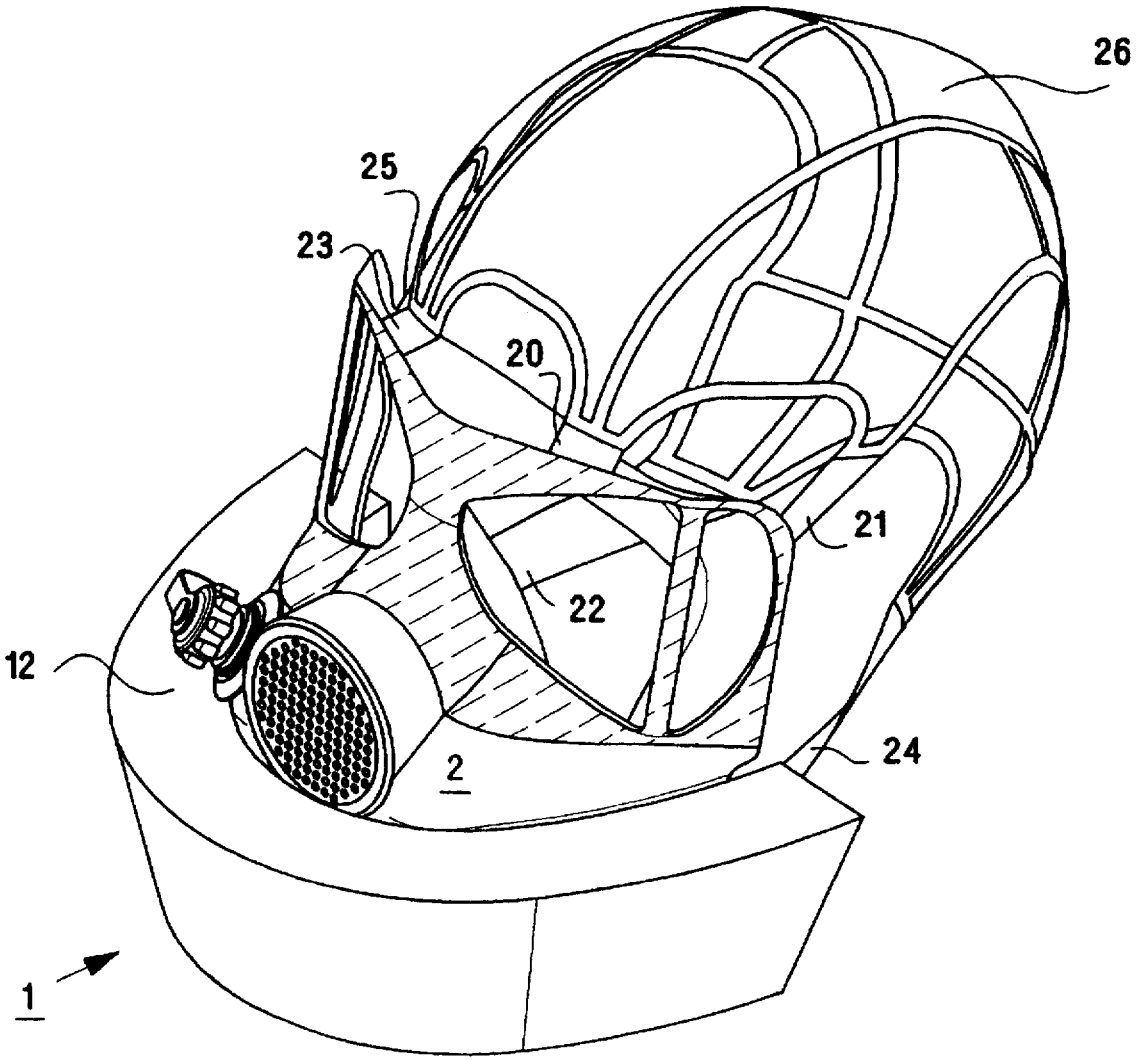
FIG. 2 is a perspective view of the breathing mask according to FIG. 1 with the cassette filter in place.

The cassette filter 12 has gas inlet openings 17, 18 on its side parts 15, 16, and the flow of gas is symmetrical from the gas inlet openings 17, 18 to the filter connection 13. FIG. 1 shows the breathing mask 1 with the cassette filter 12 removed. In contrast, FIG. 2 shows the breathing mask 1 with the cassette filter 12 attached. Identical components are designated in FIG. 2 with the same reference numbers as in FIG. 1.

Six fastening points 20, 21, 22, 23, 24, 25 for a head harness 26 are provided on the mask body 2, and two of the fastening points 22, 24 are arranged on the mask body 2 at the level of the filter mount 8 to support the mask body 2 in the area of its center of gravity. The head harness 26 is sewn together from individual, biaxially stretchable pieces of fabric. The relaxed state of the head harness 26 is illustrated in FIGS. 1 and 2. Due to the concave shape of the head harness 26 in the relaxed state, especially good snug fit is obtained on the head of the mask user, not shown in FIGS. 1 and 2.

While a specific embodiment of the invention has been shown and described in detail to illustrate the application of the principles of the invention, it will be understood that the invention may be embodied otherwise without departing from such principles.

What is claimed is:

1. A breathing mask, comprising:

a mask body provided as a full mask with a cheek area, a middle filter connection region and a field of vision region having a transparent, flexible elastomer section;

individual, segmented eye-protective lenses made of a solid material, said lenses being inserted in said transparent, flexible elastomer section; and a filter with a said filter connection for removably attaching said filter to said mask body, said filter being arranged adjacent to at least one of said middle filter connection region of said mask body and a side of said middle filter connection region of said mask body, said filter including a filter element extending in a U-shaped manner from adjacent to said middle filter connection region of said mask body to adjacent to said cheek area.

2. A breathing mask in accordance with claim 1, wherein the said eye-protective lenses comprise:

a first set of triangular eye-protective lenses tapering toward a center of said of said mask body; and a second set of eye-protective lenses extending in a round shape in a rearward direction at a side area of said mask body.

3. A breathing mask in accordance with claim 1, further comprising: a bracket for a speaking membrane provided on said mask body above said filter element.

4. A breathing mask in accordance with claim 1, further comprising: an expiration valve on said mask body under said filter element.

5. A breathing mask in accordance with claim 1, wherein said filter element includes gas inlet openings provided on side parts of said filter element, said side parts being located adjacent to cheek areas of said mask body.

6. A breathing mask in accordance with claim 1, wherein said filter element comprises a cassette filter with a filter housing that can be opened and into which air-cleaning layers can be placed.

7. A breathing mask in accordance with claim 1, further comprising:

fastening points on said mask body; and a multiarmed head harness, with arms connected to said fastening points, two of said fastening points being arranged on said mask body at a level of said filter element.

8. A breathing mask in accordance with claim 7, wherein some of said fastening points are formed as part of said filter element.

9. A breathing mask in accordance with claim 1, wherein said middle filter connection region of said mask body defines a filter mount shaped corresponding to an inner surface of said filter element whereby said filter element can be pushed over said filter mount.

10. A breathing mask in accordance with claim 9, wherein said mask body includes a breathing connection at said middle filter connection region of said mask body, said breathing connection for engaging said filter connection at said filter mount.

11. A breathing mask in accordance with claim 10, wherein said breathing connection and the said filter connection form one of a plug and receptor connection, a screw connection and a bayonet connection.

* * * * *